US008069811B2

(12) United States Patent
Ciaccia

(10) Patent No.: US 8,069,811 B2
(45) Date of Patent: Dec. 6, 2011

(54) FLAG POLE

(76) Inventor: Mark Ciaccia, Rochester, NY (US)

( * ) Notice: Subject to any disclaimer, the term of this patent is extended or adjusted under 35 U.S.C. 154(b) by 118 days.

(21) Appl. No.: 11/534,944

(22) Filed: Sep. 25, 2006

(65) Prior Publication Data

US 2007/0068444 A1 Mar. 29, 2007

Related U.S. Application Data

(63) Continuation-in-part of application No. 10/681,798, filed on Oct. 8, 2003, now abandoned, which is a continuation-in-part of application No. 10/678,857, filed on Oct. 3, 2003, now abandoned.

(51) Int. Cl.
*G09F 17/00* (2006.01)

(52) U.S. Cl. ..... 116/173; 116/174

(58) Field of Classification Search ..... 116/173–175, 116/28 R, 209; 40/602, 607.01, 430, 440
See application file for complete search history.

(56) References Cited

U.S. PATENT DOCUMENTS 1,171,917 A * 2/1916 Axford ..... 116/173
1,256,232 A * 2/1918 Howard ..... 116/173
1,258,022 A * 3/1918 Kray ..... 116/173
1,273,098 A 7/1918 Schumann
1,306,915 A * 6/1919 Klamroth ..... 116/174
1,383,234 A * 6/1921 Raguse ..... 116/173
D61,088 S 6/1922 Debnam
1,740,747 A * 12/1929 Price ..... 40/441
1,855,824 A * 4/1932 Crichton ..... 116/173
1,878,447 A 9/1932 Sutphen
2,277,358 A 3/1942 Sauer
2,280,817 A * 4/1942 Freeman ..... 40/545
2,368,783 A * 2/1945 Schillinger ..... 116/174
2,383,116 A 8/1945 Elg
2,646,240 A 7/1953 Anderson
2,672,118 A * 3/1954 Martin ..... 116/174
D190,283 S * 5/1961 Turner ..... D11/181
3,476,929 A * 11/1969 Klinger ..... 362/307
3,595,202 A 7/1971 Visitacion
3,706,297 A * 12/1972 Voorhees ..... 116/174
3,732,845 A * 5/1973 Istre ..... 116/173
3,752,975 A 8/1973 Meyer
4,049,959 A 9/1977 Ledterrman
4,110,818 A 8/1978 Hempsey
4,332,210 A 6/1982 Lambert
4,553,430 A 11/1985 Behrens
4,593,877 A * 6/1986 van der Wyk ..... 248/512
4,603,652 A 8/1986 Thibault et al.
D304,039 S 10/1989 Henderson et al.
4,918,896 A 4/1990 Wiese
5,044,301 A * 9/1991 Peters et al. ..... 116/174
5,096,151 A 3/1992 Shemitz et al.
5,168,828 A 12/1992 Smyly, Sr.
5,279,250 A 1/1994 Palermo, Jr. et al.
5,291,849 A 3/1994 Zeitler
5,375,555 A 12/1994 Dolan
5,477,437 A * 12/1995 Lach ..... 362/249.16
5,495,821 A 3/1996 Brewer (Continued)

*Primary Examiner* — R. A. Smith
*Assistant Examiner* — Tania Courson
(74) *Attorney, Agent, or Firm* — Stephen B. Salai, Esq.; Michael J. Didas, Esq.; Harter Secrest & Emery LLP

(57) ABSTRACT

This invention relates to a flag pole and more specifically, to a flag pole with moveable flag clips and an electric lamp to illuminate the flag.

8 Claims, 4 Drawing Sheets

U.S. PATENT DOCUMENTS

| | | | | |
|---|---|---|---|---|
| 5,522,342 | A | 6/1996 | Chen-Chao | |
| 5,540,017 | A | 7/1996 | Eilam et al. | |
| 5,568,784 | A | 10/1996 | Willis et al. | |
| 5,572,835 | A | 11/1996 | Atkins et al. | |
| 5,586,517 | A | 12/1996 | Willis et al. | |
| RE35,731 | E * | 2/1998 | Lach | 248/535 |
| 5,870,968 | A | 2/1999 | Dundorf | |
| 5,988,100 | A | 11/1999 | Schmitt | |
| 6,192,824 | B1 * | 2/2001 | Chang | 116/173 |
| D439,697 | S | 3/2001 | Klaus | |
| 6,227,683 | B1 * | 5/2001 | Tukia | 362/303 |
| 6,455,767 | B1 | 9/2002 | Muller | |
| 6,491,407 | B1 | 12/2002 | Beadle | |
| D479,836 | S | 9/2003 | Thornton et al. | |
| 6,622,649 | B1 | 9/2003 | Shaw | |
| 6,668,750 | B1 | 12/2003 | Walz et al. | |
| 6,799,539 | B2 | 10/2004 | Suenaga et al. | |
| 6,811,132 | B1 * | 11/2004 | Ferdinand et al. | 248/538 |
| D499,666 | S * | 12/2004 | Ciaccia | D11/181 |
| 6,845,730 | B2 | 1/2005 | Cardarelli | |
| 6,857,386 | B2 | 2/2005 | Brewer | |
| 6,955,456 | B2 * | 10/2005 | Schroeder | 362/431 |
| D535,584 | S * | 1/2007 | Garrett | D11/181 |
| 7,192,168 | B2 * | 3/2007 | Day | 362/431 |
| 7,217,015 | B2 * | 5/2007 | Cocciardi | 362/429 |
| 7,699,508 | B2 * | 4/2010 | Schroeder | 362/431 |
| 2002/0124447 | A1 | 9/2002 | Burke | |
| 2004/0083633 | A1 * | 5/2004 | Mueller | 40/541 |
| 2005/0083693 | A1 * | 4/2005 | Garrett | 362/253 |
| 2005/0199176 | A1 * | 9/2005 | Orton et al. | 116/174 |
| 2006/0118029 | A1 * | 6/2006 | Clark | 116/173 |

* cited by examiner

FLAG POLE

CROSS-REFERENCE TO RELATED APPLICATIONS

This Application is a Continuation-in-Part of U.S. application Ser. No. 10/681,798, filed on Oct. 8, 2003, which is a continuation-in-part of Ser. No. 10/678,857, filed on Oct. 3, 2003, entitled Flag Pole.

BACKGROUND OF THE INVENTION

1. Field of the Invention

This invention relates to a flag pole and more specifically, to a flag pole with rotatable flag clips and an electric lamp to illuminate the flag.

2. Background art

The problem of properly displaying a flag is very important since flags must be illuminated at night and should be removed when in inclement weather. Another problem is that on windy days, a flag may become wrapped or "furled" around the pole. People have attempted to solve this situation by having automatic reels and timers. These solutions are often expensive and difficult for the flag owner to operate easily.

It is an aim of this present invention to present a user-friendly system that will allow a flag owner to display a flag properly under all conditions and for easy removal of the flag. Also, this invention will allow the flag to move easily around the flag pole and not get tangled.

BRIEF SUMMARY OF THE INVENTION

This invention relates to a flag pole and more specifically, to a flag pole with rotatable flag clips and an electric lamp to illuminate the flag.

BRIEF DESCRIPTION OF THE SEVERAL VIEWS OF THE DRAWINGS

For a further understanding of this present invention, reference should be made to the following detailed description in conjunction with the accompanying drawings.

DETAILED DESCRIPTION OF THE INVENTION

Figure 1:
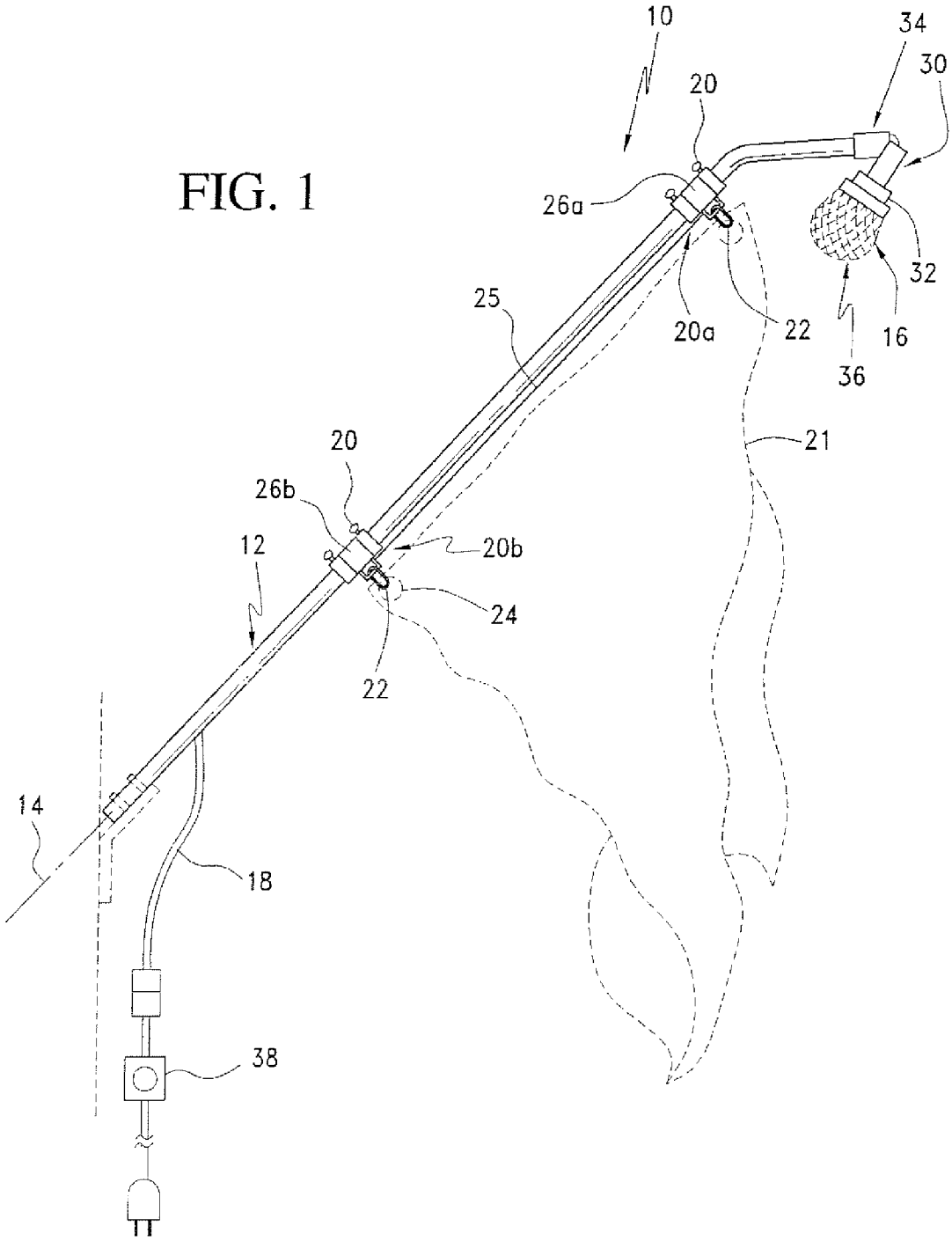
FIG. 1 is a perspective view of a flag pole of the present invention.

The problem of a flag wrapping around a pole in the wind is particularly acute when the pole is attached to a bracket on the side of a building, especially when it is positioned at an angle with the building wall. FIG. 1 shows an embodiment of the flag pole, generally indicated at 10, that could be used with a 220 voltage power source. The flag pole 10 including a staff 12 with a longitudinal axis 14 and a light 16 on one end. An electrical power cord 18 can be attached to the staff 12 for supplying electricity to the light 16. In this case, the electrical power cord 18 is shown contained within the staff 12 to protect it from the elements but one skilled in the art would understand that there are other ways to power the light.

FIG. 1 shows two connectors 20*a*, 20*b*, also referred to as "wind control flag clips," mounted on the staff 12. Each of the connectors includes a sleeve 26 that is free to rotate about the longitudinal axis 14. The connectors 20 are fixed longitudinally relative to the staff, and thus do not move up and down the staff, but stay in place. The sleeves 26 are capable of being releasably attached to a flag 21 using a clip 22 which attaches to a grommet 24 on the flag 21 or other flag attaching portion of the flag. When so attached, the leading edge of the flag, i.e., the edge of the flag closest to the staff, is substantially unfettered. That is, the flag is not fixed along the leading edge except at the clips 22. The connectors 20, and more particularly the sleeves 26, allow the flag to swing freely 360° around the longitudinal axis of the staff and thus the flag does not get wound up or furled on to the staff.

The connectors in a preferred embodiment further include a rigid connecting rod 25 that is attached at its opposite ends to each of the sleeves 26. Connecting the sleeves in this fashion ensures that the sleeves rotate in concert about the axis 14 of the flag pole. For example, if the top of the flag is wind blown so its sleeve 26*a* turns about the flag pole axis, sleeve 26*b* also turns. Forcing the two sleeves 26*a*, 26*b* to move in concert insures that a wind blown flag does not furl or wrap about the flag pole. This allows the movement of one part of the flag, such as the top, to move another part of the flag, such as the bottom.

Figure 5:
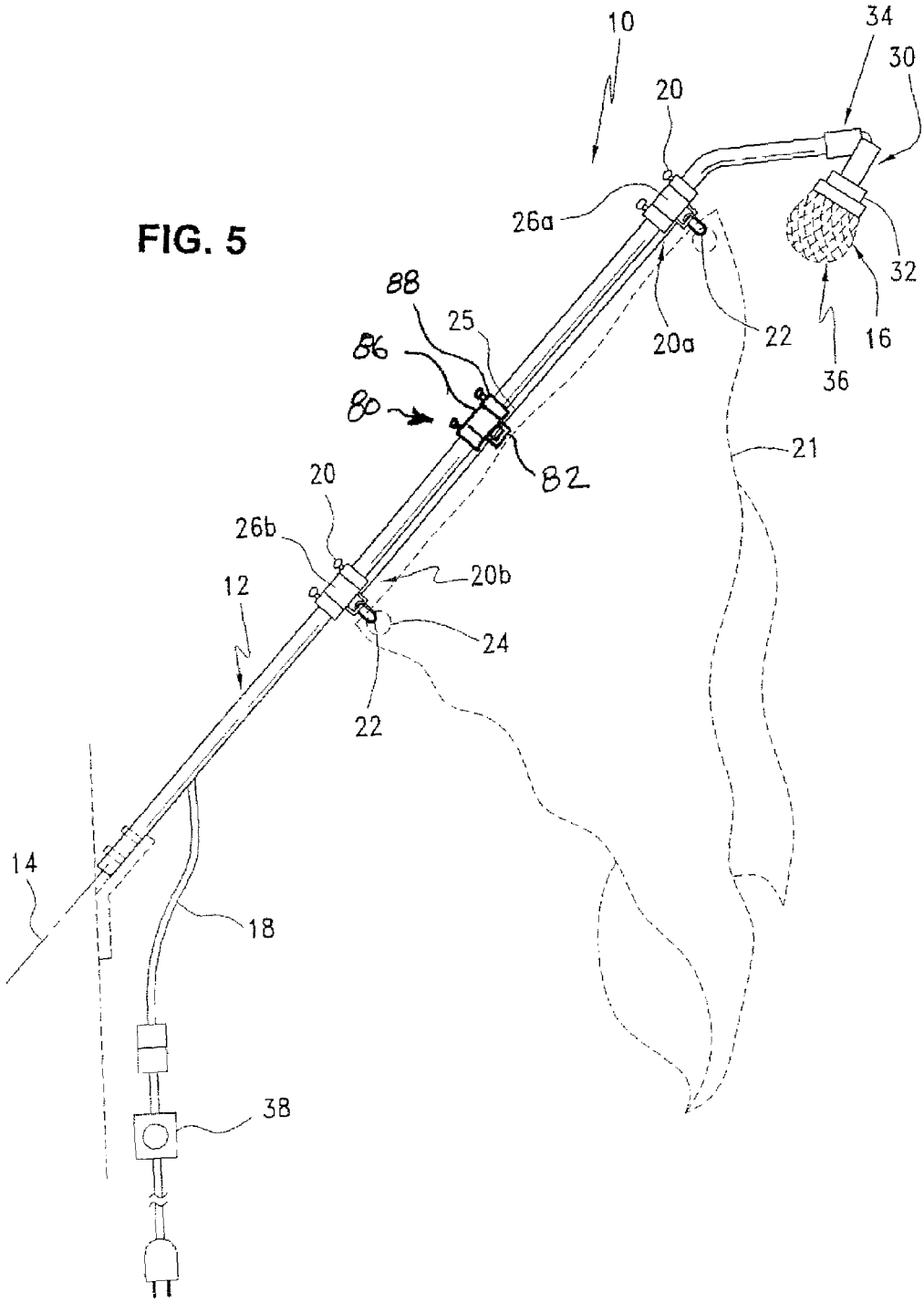
FIG. 5 is a still further embodiment of the flag pole.

As a further measure to ensure that the sleeves rotate in concert about the axis 14 of the flag pole, the flag pole assembly may further include a pivotal rod connector 80 disposed on the staff intermediate the connectors 20, as depicted in FIG. 5. The rod connector 80 preferably includes a sleeve 86 rotatable about the flag pole, and the rod connector 80 preferably is in communication with the rigid connecting rod 25. For example, the sleeve 86 may include an opening formed transversely therethrough (distinct from the opening in which the staff is received) in which the connector rod 25 is received. Alternatively, a clip 82 may be provided on the sleeve 86 for attachment to the connector rod 25. The sleeve 86 rotates about the staff 12 in substantially the same manner as which the sleeves 26*a*, 26*b* rotate about the staff 12, and thus the connector 80 provides additional rigidity to the connecting rod 25 to further ensure that the entire flag rotates around the staff 12, for example, when the flag is blown by the wind. Although not necessary, the rod connector 80 preferably is fixed longitudinally on the staff 12, for example, using clamps 88 similar to those described above with reference to FIG. 2. Alternatively, the sleeve 86 may be formed in a circumferential indent formed in the staff as discussed above with reference to FIG. 3. Of course, more than one rod connector 80 may be used for added stability, for example, when relatively larger flags are to be flown.

Figure 2:
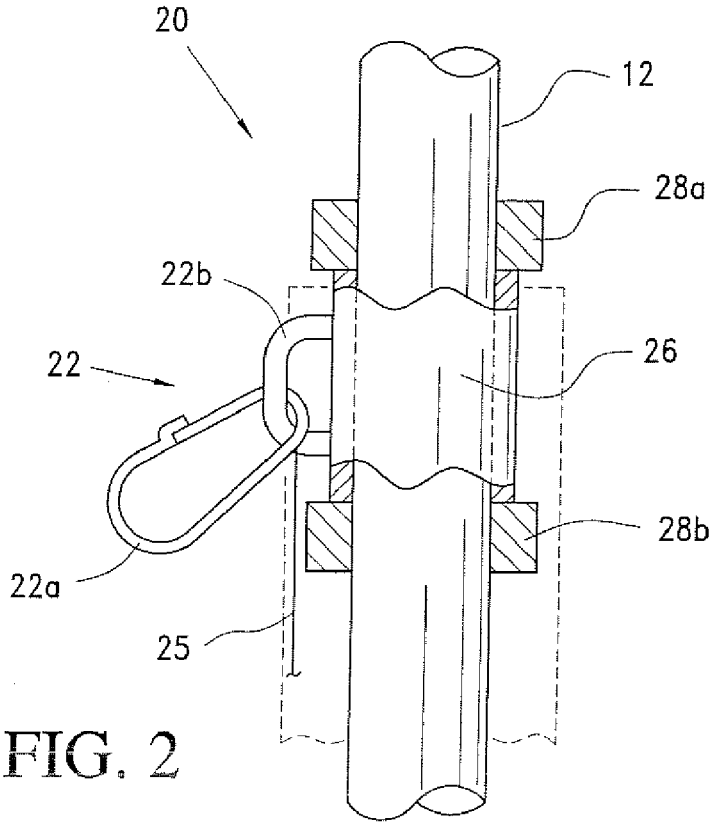
FIG. 2 is a detailed view of a connector.

FIG. 2 shows the connector 20 as including a sleeve 26 that encircles the staff 12 and is free to rotate about the staff. Although the preferred embodiment does not include roller bearings, the sleeve could contain movement means such as roller bearings, ball bearings or other devices to enhance rotation of the sleeve. Clamps 28*a*, 28*b* are placed on either side of the sleeve to hold the sleeve in place on the staff 12. Attached to the sleeve 26 is the clip 22 for attaching to the flag. The clip 22 may consist of one or more parts including a clipping portion 22*a* and a holder 22*b*. FIG. 2 further shows the rigid rod 25 that connects the sleeves 26 of one connector 20 to the sleeve of the other. This rod 25 preferably is attached directly to the holder 22*b* as shown. However, it also can be attached directly to the sleeve portion 26. As an alternative to the rigid rod 25, a tubular member (not shown) slidably disposed once the flag pole shaft 12 can be attached at its ends directly to the holder 22*b* or sleeve 26 of both connectors.

The connector 20, including the sleeve 26, one or more longitudinally fixable clamps 28 to hold the sleeve on the flag pole 10, the rod 25, and the clip 22 can form a flag pole assembly kit for converting a standard flag pole into a flag pole that prevents flag wrapping or furling of the flag around the pole.

FIG. 1 also shows the light 16 connected to the staff 12 with a threaded coupling 30 connected to an adjustable light socket 32. The threaded coupling 30 fits into a one half inch compression connector 34 so that the light can sit on the staff 12. The shaft preferably is a tube that has a 32° bend so that the light 16 will shine on the flag. The light could be a 50 watt halogen, par-20 Philips Masterline Halogen, or other light appropriate for outdoor conditions. This embodiment has a protective cage 36 to protect the flag material from burning if the flag would happen to touch the light 16.

The light 16 is connected to a power source by the cord 18 that should be weatherproof with a weatherproof plug, cord caps, and receptacle. The tube forming the staff 12 has an opening (not shown) in the lower end. The cord extends through the lower opening and terminates in a plug that can be inserted into a conventional outdoor electrical socket. A dusk-to-dawn sensor 38 allows the flag to be lit at all times when there is not sufficient light to illuminate the flag. This is necessary in certain applications since it is required by law that a flag be lit when it is dark if it is not brought down during the evening hours.

Figure 3:
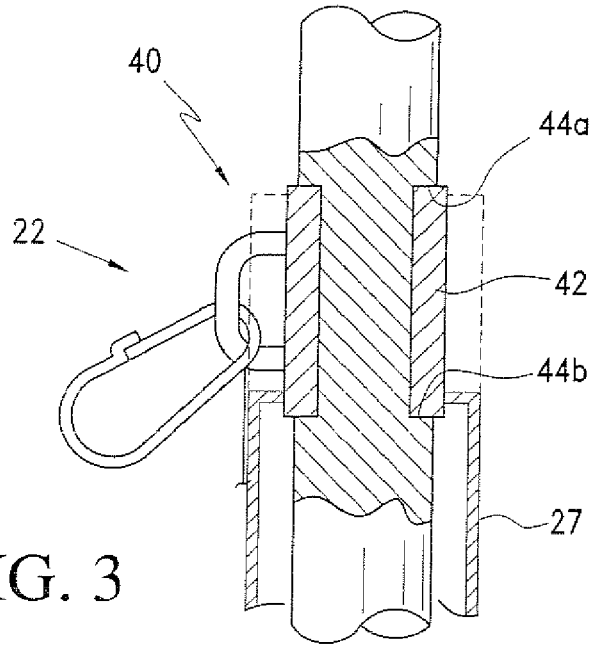
FIG. 3 is another view of a connector and a portion of the flag pole.

FIG. 3 shows a connector 40 including a sleeve 42 that sits in a circumferential indent formed by the staff 12. Clamps are not necessary in this embodiment of the connector since the edges 44*a*, 44*b* act as stops to hold the connector in position. Attached to the sleeve 42 is the clip 22 for attaching the flag. In this case, the sleeve can be snapped into the indent, or the staff 12 can be screwed together in two pieces forming an indent. In either case, the sleeve 42 is free to turn in the indent about the axis of the staff 12. In the FIG. 4 embodiment, a tube 27 is slidably disposed on the flag pole and is attached at its ends to the sleeves 42 of the two connectors 22. This tube 27 is an alternative to the rod 25 of FIGS. 1 and 2 for insuring that the sleeves 42 rotate in concert about the flag pole.

Figure 4:
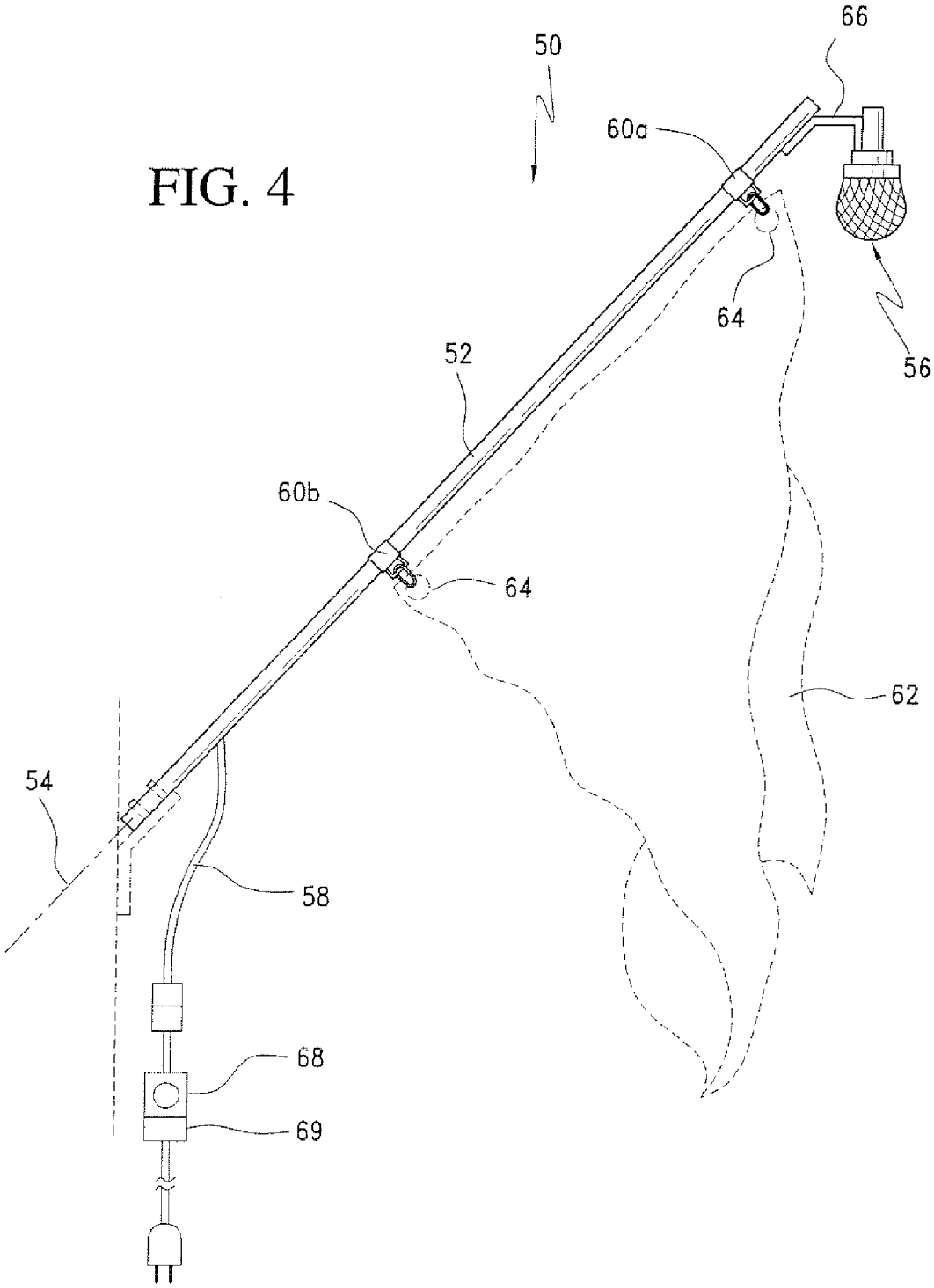
FIG. 4 is another embodiment of the flag pole.

FIG. 4 shows an embodiment of the flag pole that can be used with power sources that produce less than 110 volts. The flag pole 50 has a staff 52 with a longitudinal axis 54 with an optional light 56 on one end and an electrical power cord 58 attached to the staff 52, which preferably is threaded through the interior of the staff 52.

FIG. 4 shows two connectors 60*a*, 60*b* mounted to the staff 52 for rotation about the longitudinal axis 54. The connectors 60 are fixed longitudinally relative to the staff and thus do not move up and down the staff, but stay in place. Each connector 60*a*, 60*b* is constructed so that it can move circumferentially around the staff 52 as described above. The connector is also capable of being releasably attached to a flag 62 that may have a grommet 64 or other flag attaching portion that can be used to attach the flag to hold the flag to the staff 52. The connectors 60 allow the flag to swing freely 360° around the longitudinal axis of the staff 52 and thus the flag does not get wound up or furled on to the staff 52.

The optional light 56 shown in FIG. 4 is shown with a mounting bracket 66 so that the light can be attached to the staff 52, here preferably a tube. This staff 52 is shown without a bend and uses the angle of the bracket to ensure the lamp 56 will shine on the flag. The light could be a low voltage spot light appropriate for outdoor conditions. This embodiment may have a protective cage to protect the flag material from burning if the flag should happen to touch the light 56. The light 56 is connected to a power source by the cord 58 that should be weatherproof with a weatherproof plug, cord caps, and receptacle, and can have a dusk-to-dawn sensor 68 that allows the flag to be lit at all times when there is not sufficient light to shine on the flag. In this embodiment the sensor 68 also embodies a low voltage transformer 69.

While we have described the invention in connection with certain embodiments, we are aware that numerous departures may be made therein without departing from the spirit of the invention and scope of the appended claims.

The invention claimed is:

1. A flagpole assembly comprising a staff having a longitudinal axis, the staff having an end mountable to a wall;

a pair of connectors mounted to the staff at a fixed longitudinal distance, each of the connectors having a rotatable portion rotatable about the longitudinal axis and each having an attachment mechanism;

a flag releasably attached to the pair of connectors at the attachment mechanisms;

a rod extending between and attached at opposite ends to both connectors, the rod maintaining a rotational relationship of the connectors about the staff and spaced from the flag attached to the pair of connectors at the attachment mechanisms;

a rod connector mounted to the staff intermediate the pair of connectors, the rod connector having a rotatable portion attached to the rod and rotatable about the longitudinal axis; and an electric light unit mounted on the staff and projecting light on the flag.

2. The flag pole assembly of claim 1 wherein the rod connector is fixed longitudinally on the staff.

3. The flag pole assembly of claim 1 further comprising a tube that at least partially surrounds the staff and is attached at its ends to each of the connectors.

4. The flag pole of claim 1, wherein the pair of connectors and the rod connector comprise one or more roller bearings facilitating rotation.

5. The flag pole assembly of claim 1, further comprising an electrical cord attached to the staff and providing power from an electrical source proximate the wall to the electric light unit.

6. The flag pole assembly of claim 5, wherein the staff is tubular and has an opening proximate each end, the electrical cord extending through the openings and disposed in the staff along the longitudinal length of the staff.

7. The flag pole assembly of claim 1, wherein the light unit includes a protective cage.

8. The flag pole kit of claim 1, further comprising a wall mountable bracket receiving the end of the staff and supporting the flag staff at an angle with respect to a vertical wall.

* * * * *